US010555622B2

(12) United States Patent
Clarke

(10) Patent No.: US 10,555,622 B2
(45) Date of Patent: Feb. 11, 2020

(54) DISPENSING DEVICE

(76) Inventor: Stephen William Clarke, Clitheroe (GB)

( * ) Notice: Subject to any disclaimer, the term of this patent is extended or adjusted under 35 U.S.C. 154(b) by 398 days.

(21) Appl. No.: 12/665,541

(22) PCT Filed: Jun. 18, 2008

(86) PCT No.: PCT/GB2008/050459
§ 371 (c)(1),
(2), (4) Date: Dec. 18, 2009

(87) PCT Pub. No.: WO2008/155575
PCT Pub. Date: Dec. 24, 2008

(65) Prior Publication Data

US 2010/0193538 A1 Aug. 5, 2010

(30) Foreign Application Priority Data

Jun. 18, 2007 (GB) ..... 0711736.9

(51) Int. Cl.
*B65D 83/00* (2006.01)
*A47F 1/04* (2006.01)

(52) U.S. Cl.
CPC ..... *A47F 1/04* (2013.01)

(58) Field of Classification Search
CPC ..... A47F 1/04
USPC ..... 221/6, 289, 295, 2
See application file for complete search history.

(56) References Cited

U.S. PATENT DOCUMENTS

| | | | | | |
|---|---|---|---|---|---|
| 1,393,964 | A * | 10/1921 | Potts | G07F 9/02 | 116/215 |
| 2,784,871 | A * | 3/1957 | Gabrielsen | G07F 9/02 | 221/19 |
| 3,270,916 | A * | 9/1966 | Lyman | G07F 9/02 | 221/6 |
| RE29,796 | E * | 10/1978 | Yamamoto et al. | 194/210 | |
| 4,744,489 | A * | 5/1988 | Binder et al. | 221/6 | |
| 5,253,782 | A * | 10/1993 | Gates | G07F 11/54 | 221/105 |
| 5,706,976 | A * | 1/1998 | Purkey | 221/6 | |
| 5,992,652 | A | 11/1999 | Springs | | |
| 6,581,356 | B2 * | 6/2003 | Kim | 53/154 | |
| 6,779,663 | B1 * | 8/2004 | Pocsi | 206/534 | |
| 7,146,246 | B2 * | 12/2006 | Clarke | 700/236 | |

(Continued)

FOREIGN PATENT DOCUMENTS

| | | |
|---|---|---|
| GB | 2327668 | 10/2000 |
| WO | 2006/060448 A | 6/2006 |

*Primary Examiner* — Michael Collins
(74) *Attorney, Agent, or Firm* — Akerman LLP

(57) ABSTRACT

A dispensing device comprises a loading chamber (12), a dispensing chamber (14), located beneath the loading chamber, a gate or shutter (24) movable between a first open position and a second closed position to allow selective communication of the loading chamber and the dispensing chamber. The device further comprises a first indicating means in the form of a first indicator member (114) which is retainable in a first-retracted position when the gate or shutter (24) is in the closed position and which is displaceable to a second, extended position when the gate or shutter is moved from the closed position to the open position. The device further comprises second indicating means (116) which is actuable to display a second visible signal to indicate that the first signal has been observed.

34 Claims, 9 Drawing Sheets

(56) References Cited

U.S. PATENT DOCUMENTS

| | | | | |
|---|---|---|---|---|
| 7,694,589 | B2 * | 4/2010 | Mehus et al. | 73/862.52 |
| 7,747,345 | B2 * | 6/2010 | Ohmura et al. | 700/231 |
| 7,922,037 | B2 * | 4/2011 | Ohmura et al. | 221/123 |
| 8,006,859 | B2 * | 8/2011 | Clarke | 220/500 |
| 8,265,785 | B2 * | 9/2012 | Pickett | 700/214 |
| 8,438,067 | B2 * | 5/2013 | Omura et al. | 705/23 |
| 2004/0154688 | A1 * | 8/2004 | Geltser | B65B 5/103 141/2 |
| 2007/0150092 | A1 * | 6/2007 | Ohmura et al. | 700/231 |
| 2008/0247279 | A1 * | 10/2008 | Pickett | 369/30.42 |

* cited by examiner

DISPENSING DEVICE

CROSS-REFERENCE TO RELATED APPLICATIONS

This application claims the benefit of International Application No. PCT/GB2008/050459, filed Jun. 18, 2008, which claims priority to Great Britain Patent Application No. 0711736.9, filed Jun. 18, 2007 which are incorporated herein by reference in their entirety.

BACKGROUND OF THE INVENTION

Field of Invention

The present invention relates to dispensing devices and in particular, but not exclusively, to dispensing devices for dispensing small items such as components required in workshops, on assembly lines and the like.

Description of Related Art

GB 2327668A discloses a dispensing device having an upper loading chamber, a dispensing chamber located beneath the loading chamber and gate or shutter located between the two chambers. The shutter is movable between a first open position and a second closed position to allow selected communication of the loading chamber and dispensing chamber. In this way, products can be taken from the lower dispensing chamber which, when emptied, can be refilled with products from the upper, loading chamber by withdrawing the gate or shutter to the first, open position. The upper loading chamber can then be refilled for when the dispensing chamber is empty.

WO 02/74138 discloses a modification of the arrangement in GB 2327668, whereby withdrawal of the gate or shutter to replenish the lower, dispensing chamber generates a signal which illuminates a lamp to indicate that the upper loading chamber requires replenishment.

BRIEF SUMMARY OF THE INVENTION

In accordance with a first aspect of the present invention, a dispensing device comprises a loading chamber, a gate or shutter movable between a first, open position and a second, closed position to allow selective communication of the loading chamber and the dispensing chamber, first indicating means for displaying a first signal indicative that the loading chamber is empty and second indicating means which is actuable to display a second visible signal to indicate that the first signal has been observed.

The second indicating means can be actuated by a person responsible for replenishing the loading chamber and can serve as a visible reassurance to users of the device that action has been taken to replenish the loading chamber.

In the absence of the second indicating means, it is not possible to determine without further investigation whether action has been taken to replenish the upper loading chamber.

Preferably, the first indicating means displays a first signal when the gate or shutter is moved from a second, closed position to the first, open position.

In a preferred embodiment, the second indicating means is actuable to display the second visible signal only after the first signal has been displayed. The device also preferably comprises means for resetting the first and second indicating means so that the first and second signals respectively are not displayed.

In a preferred embodiment, the first indicating means comprises a first indicator member which is retainable in a first, retracted position when the gate or shutter is in the closed position and which is displaceable to a second, extended position when the gate or shutter is moved from the closed position to the open position.

Preferably, the device further comprises means for biasing the indicator member from the retracted position to the extended position. The biasing means may conveniently comprise a spring.

Preferably, the first movable indicating means is pivotally mounted and is pivotable between the first, retracted position and the second, extended position.

Preferably, the first indicator member is elongate. Preferably, the elongate first indicator member is pivotally mounted at or towards one end.

In a preferred embodiment, the second indicating means comprises a second indicator member which is retainable in a first, retracted position when the gate or shutter is in the closed position and which is displaceable to a second, extended position when the gate or shutter is moved from the closed to position to the open position.

Preferably, one of the first and second indicator members is movable relative to the other to adjust the extent to which the other member is visible.

In a preferred embodiment, one of the first and second indicator members is movable relative to the other indicator member, from a first position in which the other indicator member is substantially completely obscured to a second position in which the other member is partially revealed.

The first indicator member may be movable from a first position in which the second indicator member is substantially obscured to a second position in which a portion of the second indicator member is revealed.

Preferably, when the movable first indicator member is in the second position with respect to the other indicator member, the first and second indicator members are prevented from being displaced to the first, retracted position.

The device also preferably further comprises retaining means movable with the gate or shutter which are engageable with the first indicator member to retain the first indicator member in the first, retracted position.

Preferably, when the first indicator member is displaced to the second, extended position, it impedes access to the loading chamber.

In accordance with a second aspect of the present invention, a dispensing device comprises a loading chamber, a dispensing chamber located beneath the loading chamber, a gate or shutter movable between a first, open position and a second, closed position to allow selected communication of the loading chamber and the dispensing chamber and first indicating means comprising a first indicator member which is retainable in a first, retracted position, when the gate or shutter is in the closed position and which is displaceable to a second, extended position when the gate or shutter is moved from the closed position to the open position.

Preferably, In a preferred embodiment, the first indicating means comprises a first indicator member which is retainable in a first, retracted position when the gate or shutter is in the closed position and which is displaceable to a second, extended position when the gate or shutter is moved from the closed position to the open position.

Preferably, the device further comprises means for biasing the indicator member from the retracted position to the extended position. The biasing means may conveniently comprise a spring.

Preferably, the first movable indicating means is pivotally mounted and is pivotable between the first, retracted position and the second, extended position.

Preferably, the first indicator member is elongate. Preferably, the elongate first indicator member is pivotally mounted at or towards one end.

In a preferred embodiment, the second indicating means comprises a second indicator member which is retainable in a first, retracted position when the gate or shutter is in the closed position and which is displaceable to a second, extended position when the gate or shutter is moved from the closed position to the open position.

Preferably, one of the first and second indicator members is movable relative to the other to adjust the extent to which the other member is visible.

In a preferred embodiment, one of the first and second indicator members is movable relative to the other indicator member, from a first position in which the other indicator member is substantially completely obscured to a second position in which the other member is partially revealed.

The first indicator member may be movable from a first position in which the second indicator member is substantially obscured to a second position in which a portion of the second indicator member is revealed.

Preferably, when the movable first indicator member is in the second position with respect to the other indicator member, the first and second indicator members are prevented from being displaced to the first, retracted position.

The device also preferably further comprises retaining means movable with the gate or shutter which are engageable with the first indicator member to retain the first indicator member in the first, retracted position.

Preferably, when the first indicator member is displaced to the second, extended position, it impedes access to the loading chamber.

BRIEF DESCRIPTION OF THE DRAWINGS

By way of example only, specific embodiments of the present invention will now be described, with reference to the accompanying drawings, in which:—

DETAILED DESCRIPTION OF THE INVENTION

Figure 1:
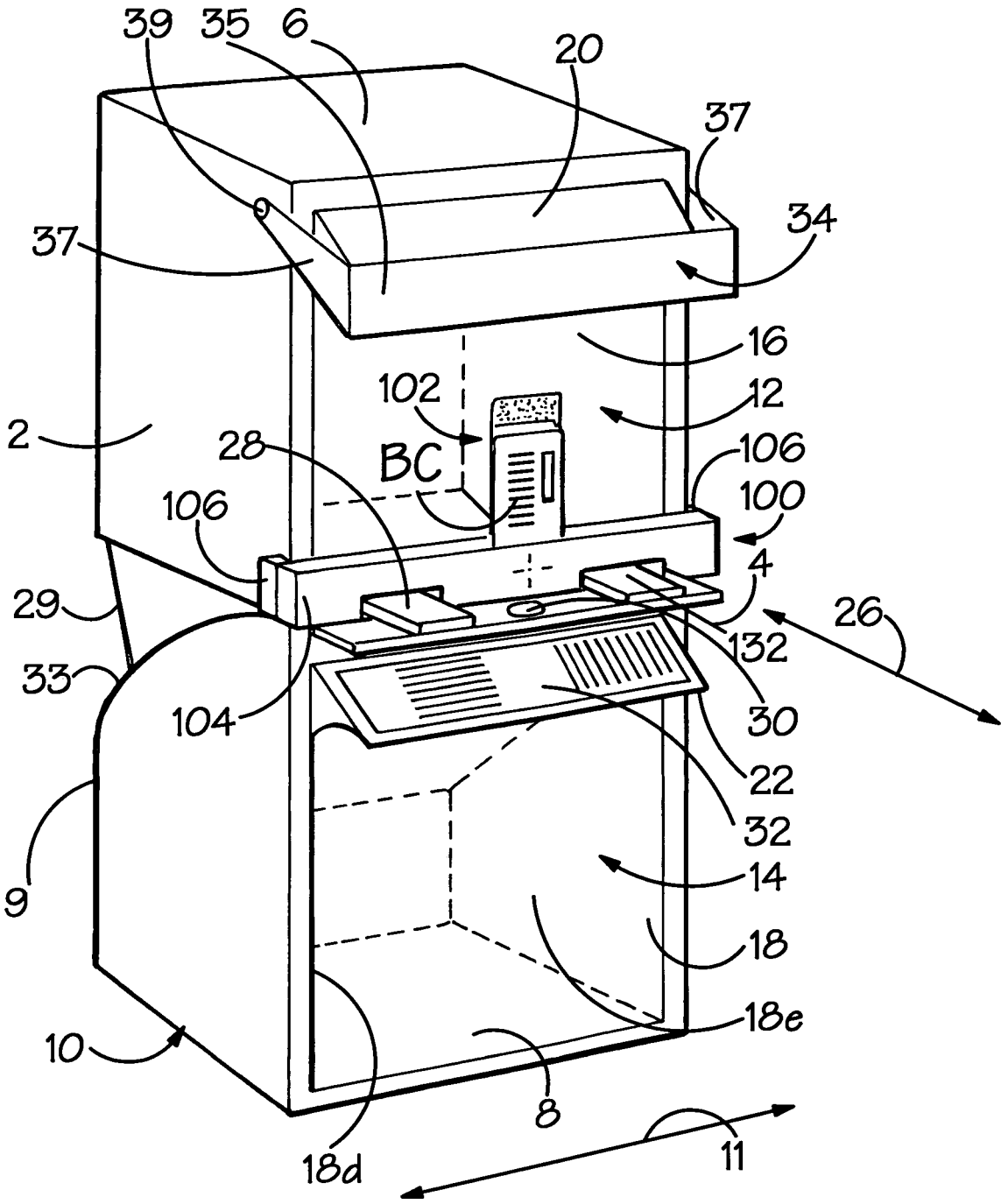
FIG. 1 is a perspective view of an embodiment of dispensing device in accordance with the present invention.

The dispensing device shown in the Figures is very similar to that disclosed in WO2006/032891. With reference to FIG. 1, FIG. 2 and FIG. 3, the dispensing device comprises a housing 10 in the shape of a rectangular box with two parallel, planar side walls 2, 4 parallel upper and lower walls 6, 8 extending perpendicular to the side walls 1, 4 and a planar rear wall 9 extending perpendicular to the side walls 2,4 and to the upper and lower walls 6,8. The rear wall 9 is provided with an inwardly-directed ridge or projection 29 across its width, having inclined upper and lower planar walls 29*a*, 29*b*. The projection 29 serves to direct articles during operation of the dispenser, as will become apparent.

The housing is divided into two discrete areas, namely an upper loading chamber 12 and a lower dispensing chamber 14, both of which can be accessed by means of hinged transparent doors 16 and 18 respectively, which are opened by means of a respective handle 20,22. Both doors 16 and 18 pivot about an axis located towards the base of the doors extending in a direction perpendicular to the side walls 2, 4. A slidable gate 24 is also provided in the device (shown in the closed or engaged position in FIG. 1) which is disposed between the loading chamber 12 and the dispensing chamber 14. The gate 24 is received in two parallel, channels (not shown) extending parallel to the base wall 8 provided on each opposed inner faces of the side walls 2,4 and can thereby slide in and out in a direction 26 parallel to the upper and lower walls 6,8. The gate 24 also forms the base of the loading chamber 12 when closed, and when disengaged permits communication between both chambers. The gate is slid into position by means of a handle 28 formed by a projecting portion of the gate which conveniently has a finger hole 30 disposed therein for a person to place a finger.

An indicating device 100 is also disposed on the front face of the dispenser, immediately above the gate 24. As will be explained, the indicator device is arranged to display an indicator finger 102 when the gate 24 is opened.

The dispensing chamber 14 comprises an upwardly open receptacle having a planar front wall 18*a*, a parallel, shorter rear wall 18*b*, a planar base wall 18*c* extending perpendicularly between the front and rear walls and two planar side walls 18*d*,18*e* extending perpendicularly to the front, rear and back walls. The uppermost edges 50 of the side walls of the dispensing chamber 14 are curved convexly and at its frontmost portion the uppermost edge of one side wall 18*d* terminates in a locking recess 48, for engagement with a locking pin, as will be explained. The front of the dispensing chamber 14 forms the door 18. The loading chamber 12 is not attached to a receptacle and the gate 24 forms the base of the chamber 12. However the loading chamber 12 has a door 16 which permits access to the chamber.

The uppermost front edge of the front face of each of the doors 16,18, is formed into a downwardly projecting handle 20,22 extending across the width of the door and a label 32 is attached to the handle 22 of the dispensing chamber 14. The label 32 contains information pertaining to the contents of the device and is supplied in addition to a bar code or similar tag. The label 32 can be placed or adhered to the handle 22 and may itself be capable of being fixed onto other handles either by means of a "snap fit" mechanism or alternatively the label may be inserted into an elongate aperture disposed within the handle 22 capable of receiving a label.

The locking chamber of the device is also provided with a locking bar 34 that is used to maintain the closure of the door 16 of the loading chamber 12 until opening is required. The locking bar consists of an elongate member 35 that is attached at either end to parallel arms 37 that are in turn pivotally connected to the side walls 2,4 by means of a pivot 39. The inner surface (not shown) of the elongate member 35 closely corresponds to the handle 20 of the door 16 such that the locking bar 34 (that may be brightly coloured with words or symbols disposed therein in) can clip over the handle 20 and therefore prevent entry to the loading chamber 16 without first un-clipping the locking bar and pivoting the arms 37 to a position such that the locking bar does not impede the movement of the door 16.

Figure 2B:
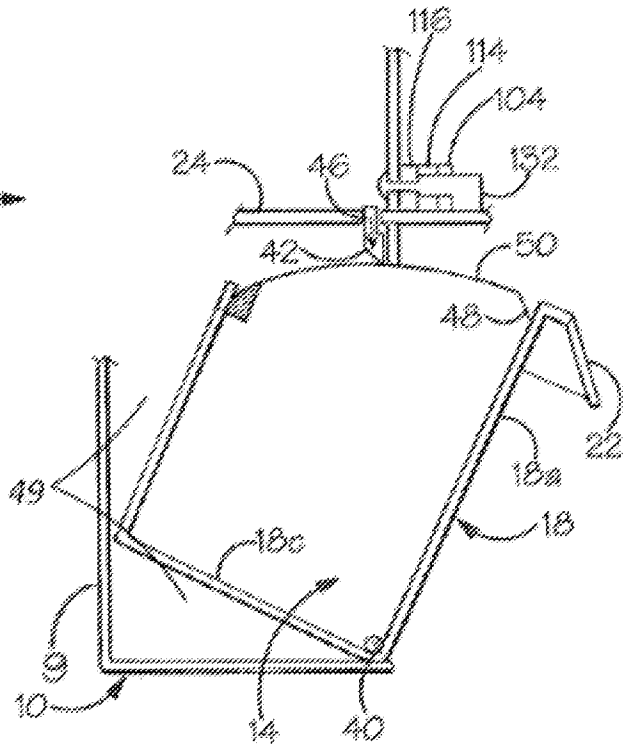
FIGS. 2*a* and 2*b* are cross-sectional side views of a lower chamber of the dispensing device of FIG. 1, with the dispensing chamber illustrated in the closed and open positions respectively.
Figure 2A:
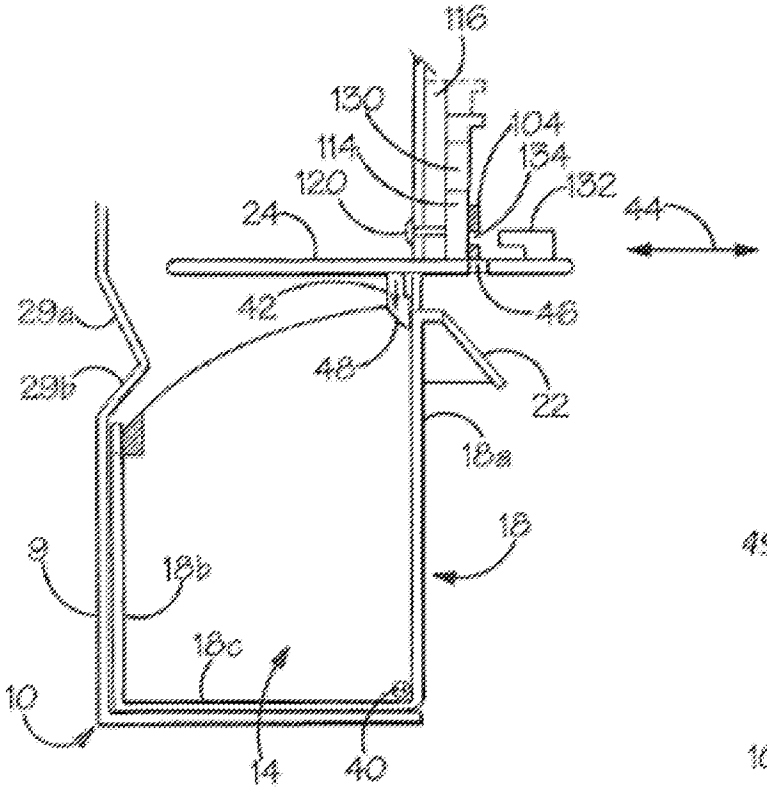
Figure 3A:
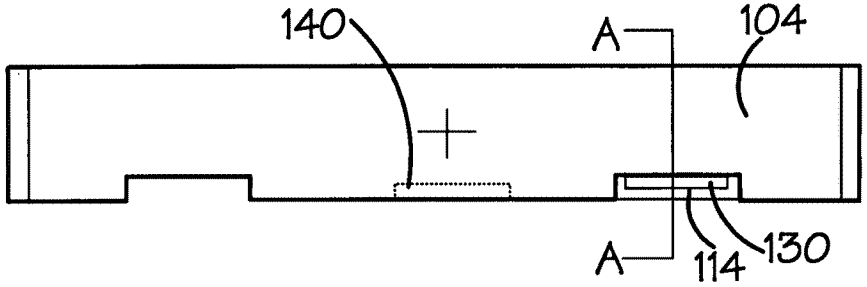
FIGS. 3*a*, 3*b* and 3*c* are front views of an indicating means of the device of FIG. 1 shown in a retracted position, a first indicating position and a second indicating position respectively.
Figure 3B:
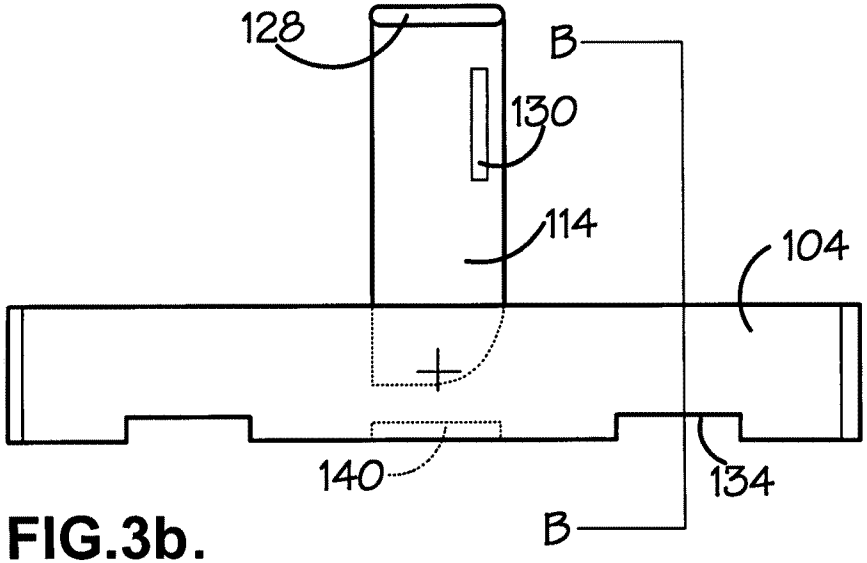
Figure 3C:
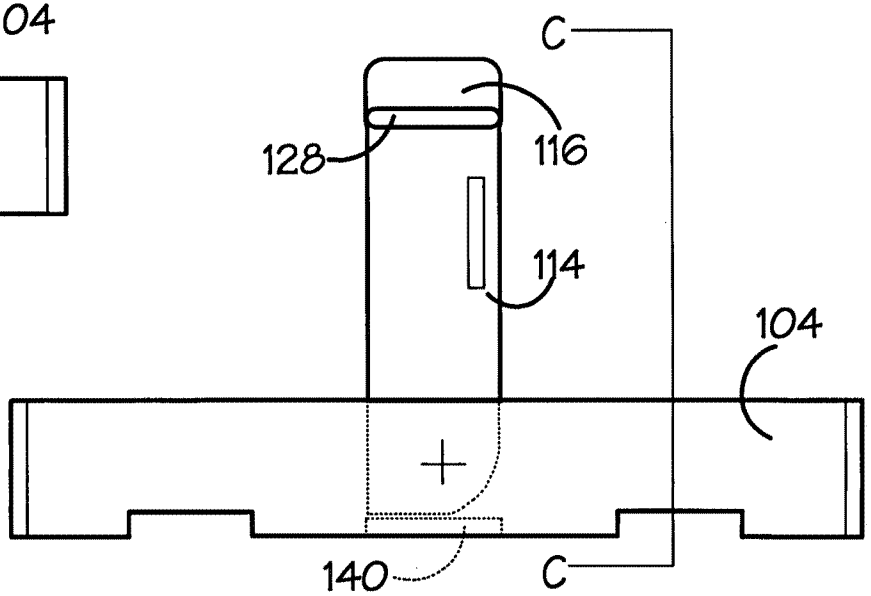

As shown in FIGS. 2*a*, 2*b*, 3*a*, 3*b* and 3*c* (which include reference numbers that correspond to those of FIG. 1) gate 24 is provided with a hole 46 or depression of non-circular cross-section which slidably receives a locking pin 42 of the same cross-section. The lower end of the locking pin 42 is provided with a horizontally and inwardly projecting lip or foot 52 which contacts the curved upper edge 50 of the side wall 18*d*. The lower end of the locking pin is complementarily shaped with the notch 48 in the upper edge of the side wall as described previously. The door 18 forms an integral part the receptacle and pivots about a stub axle 40. When the door 18 is in the closed position (FIG. 2*a*) the pin 42 drops by gravity into the notch 48. The notch 48 has an inclined surface corresponding to the base of the pin 42 and therefore the pin is received in the notch to allow the gate 20 in FIG. 2*a* to be moved freely in and out in the horizontal plane 44. When the gate 24 is slid outwardly, as shown in FIG. 2*a*, the hole 46 in the gate is no longer aligned with the pin 42 and as a result the upper end of the pin abuts the undersurface of the gate and is thereby held in engagement with the notch 48. Consequently, the door 18 is prevented from pivoting about the stub axle 40 by its engagement with the pin 30.

When the gate 24 is in the closed position (as shown in FIG. 2*b*), the pin 42 is aligned with the orifice 46 in the gate and is free to move through the aperture 48 in the gate 20. As the door 18 is pivoted forwardly, the inclined surfaces of the pin 42 and notch 48 cause the pin to be displaced upwardly, into the orifice 46 thereby both locking the gate in position and enabling the doors to continue to pivot about the axis 40. The lower end of the pin 42 can then slide over the curved inclined upper edge 50 of the side wall 18*d* of the receptacle to allow the door 18 to open. In this way the gate 24 is prevented from being slid when the door 18 is open.

Figure 4A:
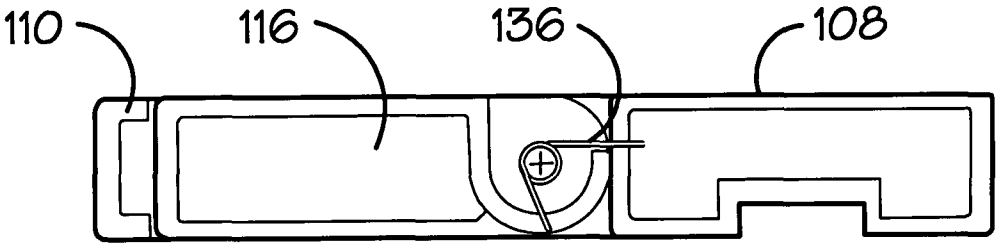
FIGS. 4*a*, 4*b* and 4*c* are rear views of the indicating means of the device of FIG. 1, corresponding to the views in FIGS. 3*a*, 3*b* and 3*c* respectively.
Figure 4B:
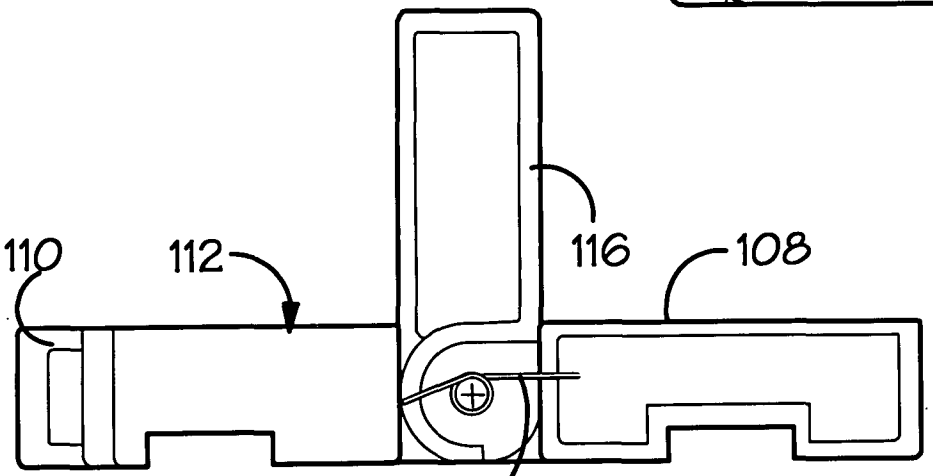
Figure 4C:
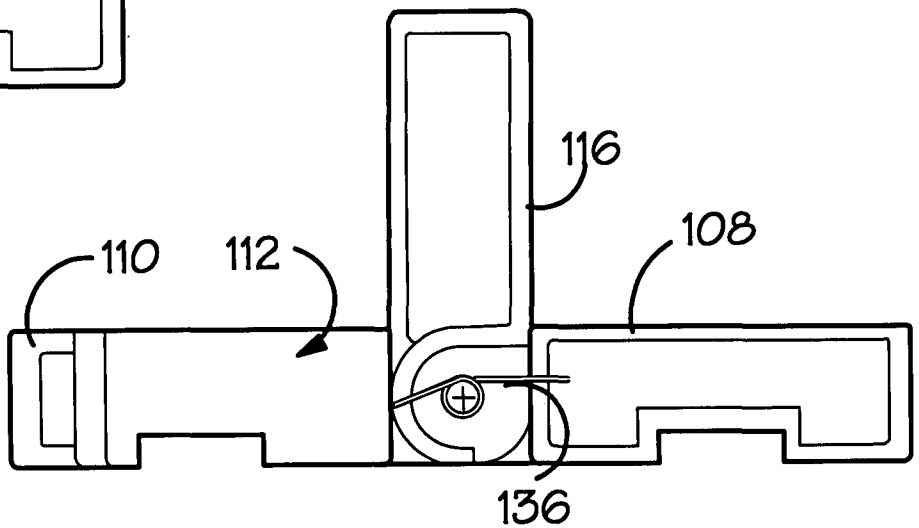
Figure 5:
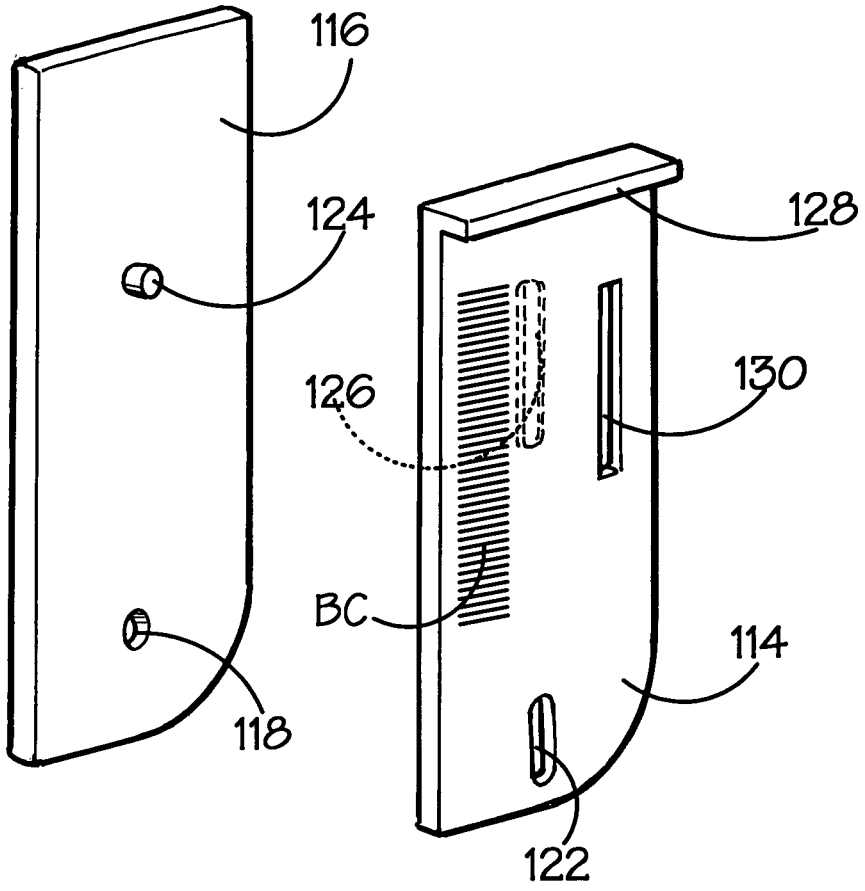
FIG. 5 is an exploded perspective view of a detail of a portion of the indicating device of FIGS. 3 and 4.
Figure 6C:
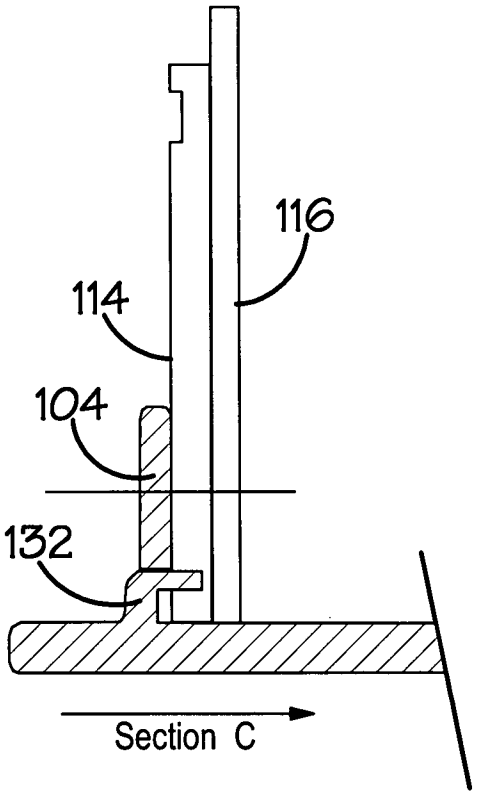
FIGS. 6*a*, 6*b* and 6*c* are cross-sectional views of the indicator means of FIGS. 3 to 5.
Figure 6B:
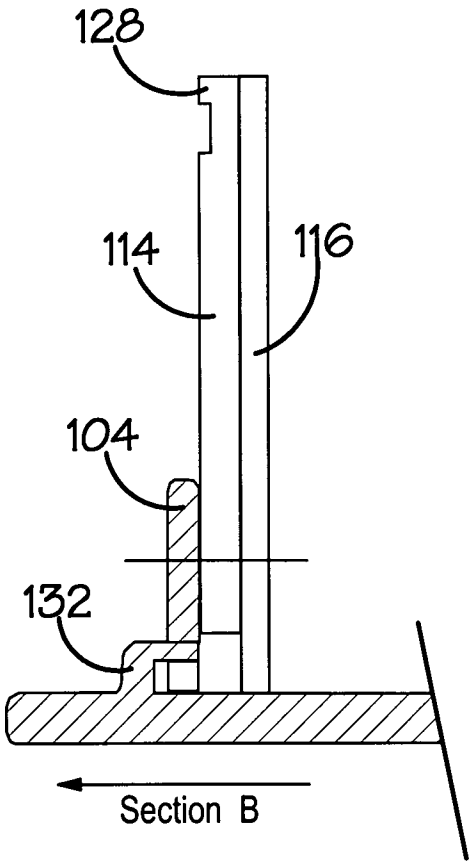
Figure 6A:
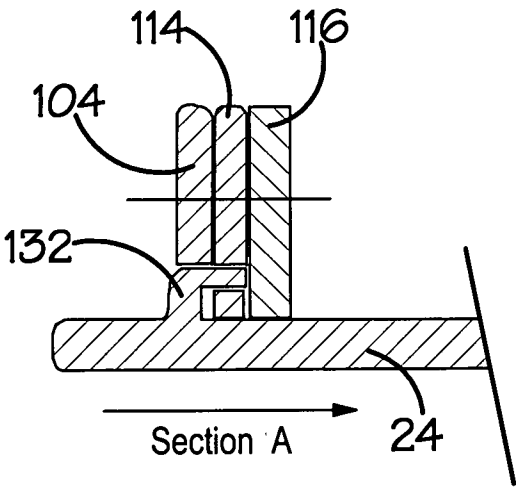
Figure 7A:
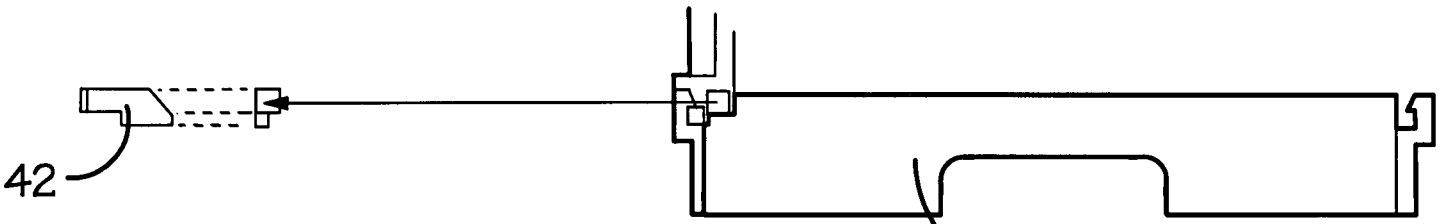
FIGS. 7*a*, 7*b* and 7*c* are top, side and inverted plan views of the retaining means for the lower dispensing chamber of the device of FIG. 1.
Figure 7B:
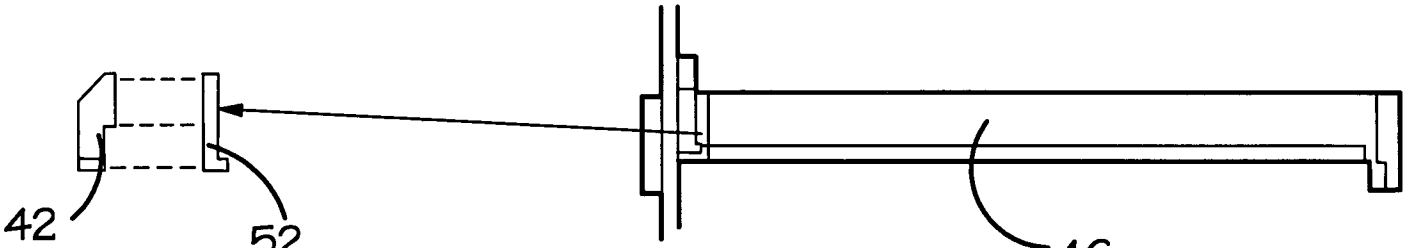
Figure 7C:
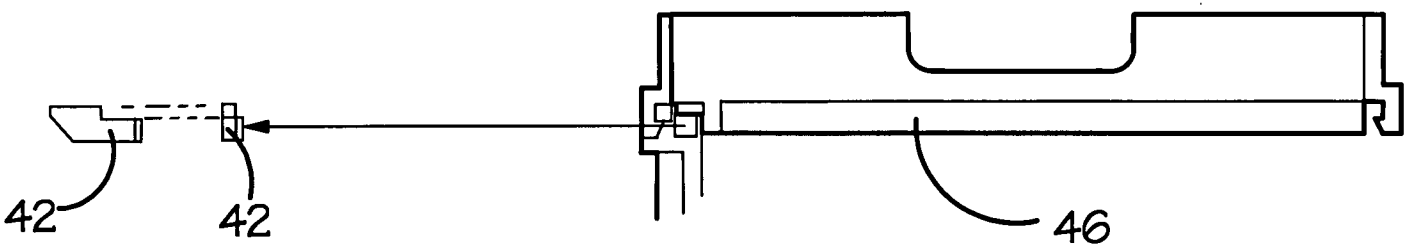

The indicating device 100 comprises an elongate cover plate 104 having an attachment lug 106 located at each end by means of which the cover plate is secured over the front face of the housing at a location immediately above the gate 24. As best seen in FIG. 4, the rear face of the cover plate 104 is provided with upstanding lugs 108, 110 which engage the front face of the housing when the cover plate 104 is installed. The portion of the cover plate between the lugs 108, 110 is thereby spaced from the front face of the housing and defines a recess 112 into which the indicator finger 102 may be received.

The indicating finger 102 is formed from front and rear elongate plastics strips 114, 116 which are generally rectangular in shape, but with a rounded right-hand bottom corner (when viewed from the front) to allow the strips to pivot through a right angle without fouling, as will be explained. The rearmost strip 116 is provided with a circular aperture 118 near its base which receives a pivot 120 which is secured in a recess formed in the rear face of the cover plate 104. The frontmost strip 114 is slightly shorter than the rearmost strip 116 and is provided with an elongate slot 122 near its lower end, the slot extending parallel to the longitudinal axis of the strip. The slot is the same diameter as the aperture 118 in the rear strip and the pivot pin 120 also passes through the slot 122, whereby the frontmost strip 114 is both pivotable with respect to the pivot pin 120 and displaceable translationally with respect to the pin. However, the front and rear strips 114, 116 are constrained to be displaceable with respect to each other longitudinally by virtue of a circular lug 124 on the front face of the rearmost strip which is seated in an elongate recess 126 in the rear face of the frontmost strip 114. The elongate recess extends parallel to the longitudinal axis of the frontmost strip and its with is the same a, or slightly larger than, the diameter of the lug 124, whereby the lug 124 is seated slidably with respect to the recess 126. The length of the recess 126 is the same length as, or slightly longer than, the length of the slot 112. The extent of the relative displacement of the two strips 114, 116 is therefore governed by the length of the slot 122 through which the pivot pin 120 passes and the length of the elongate recess 126.

The end of the frontmost strip 114 opposite to the slot 122 is provided with an outwardly projecting nose 128 for facilitating longitudinal displacement of the frontmost strip 114, as will be explained. The front face of the frontmost strip 114 is also provided with an elongate locking recess 130 towards its right-hand edge (as viewed in FIG. 1), which is adapted to receive the end of a complementarily-shaped locking projection 132 secured to the upper face of the gate 24, when the gate is in the closed position, the cover plate 104 being provided with a recess 134 in its lowermost edge to allow engagement of the locking projection 128 with the locking recess 126 in the strip 114.

The front face of the frontmost strip 114 of the indicator finger 102 also carries a bar code BC which identifies the product within the dispenser. The bar code is positioned such that it is fully visible normally but partly obscured when the frontmost strip 114 is slid downwardly with respect to the rearmost strip 116.

The rearmost strip 116 of the indicating finger 102 (and therefore the indicating finger 102 as a whole) is urged by means of a torsion spring 136 connected to the strip 116 and the rear of the cover plate 104 towards one extreme orientation ("the extended position") shown in FIG. 1 in which the indicating finger 102 extends vertically. As shown in FIG. 4, the indicating finger is prevented from pivoting past the vertical position by its abutment with one of the upstanding lugs 108 on the rear of the cover plate 104. The indicating finger 102 may be pivoted manually to the other extreme orientation, at a right angle to the other extreme position ("the retracted position"), against the force of the torsion spring 132 and may be held in that position by closing the gate 24, which causes the end of the projection 132 on the gate 24 to engage with the recess 130 in the front face of the frontmost strip 114 of the indicating finger 102.

In use, articles of the same or similar goods are placed in both the loading chamber 12 and the dispensing chamber 14 in preparation for dispensing. The bar 34 is clipped over the upper handle 20 to prevent the inadvertent opening of the door 16. The articles are readily identifiable by means of the label 32 disposed on the handle 22 and the articles held within the lower dispensing chamber 14 are removed by opening the dispensing chamber door 18. In this condition, the gate 24 is pushed in to the housing to its maximum extent. This prevents the contents of the upper loading chamber 12 from moving into the lower dispensing chamber. It also causes the locking projection 132 on the upper face of the gate 24 to engage with the locking recess 130 in the front face of the frontmost strip 114 of the indicating finger. This holds the indicating finger 102 in the retracted position and serves to indicate to an observer that the gate has not been opened, i.e. that the upper loading chamber 12 still contains products yet to be transferred to the lower dispensing chamber.

When the lower, dispensing chamber 14 is empty and requires refilling, the dispensing chamber door 18 is closed, which causes the locking pin 42 to drop into the notch 48. This allows the gate 24 to be slid outwards and at the same time engagement of the pin 42 in the notch 48 prevents the door 18 from being opened while the gate is open. Opening the gate 24 causes articles in the loading chamber 14 to drop into the dispensing chamber 14.

Opening the gate 24 also withdraws the locking projection 132 on the gate from the locking recess 130 in the front face of the frontmost strip 114 of the indicating finger 102. The indicating finger 102 is no longer held in its retracted position and so it is urged by the torsion spring 136 into the extended position as illustrated in FIG. 1. This serves to indicate to an observer that the gate 24 has been opened and that the upper, loading chamber 12 is empty and requires refilling. The frontmost strip 114 may conveniently be of a bright colour, e.g. red, so that it can be easily seen.

The gate 24 can then be slid shut, which causes the locking pin 42 to drop into the notch 48 but since the pin is aligned with the article 46 in the gate, the pin can be displaced upwardly into the orifice to allow the door 18 to be opened. This has no effect on the indicating finger 102, which remains in the vertical, extended position. The loading chamber door 16 is further locked by the bar 34 which may have words disposed thereon to the effect that it may only be opened by authorised personnel etc. In its closed position, the pin 42 permits the gate 20 to move about the plane 26,44 and releasably locks the door 18 so that articles held in the loading chamber 12 can drop into the dispensing chamber 14 without becoming lodged in the space 49 formed by the receptacle which is attached to the lower door 18. The bar 34 can be unlocked to replenish stocks in the loading chamber as and when required. Therefore, articles from the loading chamber cannot fall into the space 49 formed when the door 18 is opened (as shown in FIG. 2*b*).

When a person responsible for re-ordering stock checks the status of the dispenser after the gate 24 has been opened, the indicating finger 102 in the vertical position serves as a visible prompt that the upper, loading chamber 12 needs to be refilled. If the replacement product is immediately available, the indicating finger 102 can be pivoted back down to its retracted position and can be locked in its retracted position by engaging the locking projection 132 with the locking recess 130 on the frontmost strip 114 of the indicator finger 102. If the gate 24 is fully pushed in, it may be necessary to withdraw it slightly to allow the finger 102 to be pivoted to its retracted position and then pushed in again to engage the projection 132 in the recess 130. The upper chamber is then refilled by unfastening the locking bar 34, opening the door 16 of the upper chamber and replacing the contents. The door 16 is then re-closed and the locking bar 34 is refastened.

However, if the replacement product is not immediately available, the person responsible can make arrangements for its replacement, for example by noting the contents from the label 32 or scanning the bar code on the front face of the frontmost strip 114 of the indicator finger 102 with an appropriate scanner. When this has been done, the person then displaces the frontmost strip 114 to the indicating finger 102 downwardly, which is possible because of the elongate slot 122 through which the pivot pin 120 passes. This serves to indicate to a user of the dispenser that, although the upper, loading chamber 12 is empty, steps have been taken to order a refill. If the rearmost strip 114 of the indicating finger 102 is of a bright colour which differs from that of the frontmost strip, e.g. yellow, the visual indication will be easier to see. Since bar code BC is partially obscured when the frontmost strip 114 is slid downwardly, inadvertent duplicate scanning of the barcode can be prevented.

When the frontmost strip 114 has been displaced downwardly to reveal the top of the rearmost strip 116, the flat lower edge of the strip 114 engages either the uppermost face of the gate 24 or a rearwardly projecting lip 140 (illustrated schematically in the drawings) projecting from the centre of the lowermost portion of the cover plate 104. This prevents the finger 102 from being pivoted to its retracted position while the frontmost strip 104 is displaced. In order to pivot the finger 102 to its stowed position, the frontmost strip 104 is moved upwardly to obscure the rearmost strip 116 completely. This disengages the lower end of the frontmost strip 114 and allows the finger 102 to be pivoted to its stowed, retracted position.

When the re-ordered product is available for refilling the upper, loading chamber, the filling procedure referred to above is repeated, namely pivoting the indicator finger 102 to its stowed position and locking it in place, opening the upper loading chamber 12, refilling the loading chamber and re-closing the loading chamber as described previously.

Multiple dispensing devices may be joined to one another by a range of methods and structures may be provided on the exterior of the housing may permit the devices to be joined to one another in a modular fashion. The movement of the gate can also be linked to electronic switches/sensors, so that its movement can be detected and relayed to a computer such that the ordering of stock can be automated or semi-automated. If more than one device is used, each device can have an identification code assigned to it, so that the correct part or product is ordered. Whilst the electronic switch/sensor can be placed in a number of positions on the device, ideally, it will be positioned adjacent to the gate 24, on the panel 31 so as to monitor the movement of the gate. The electronic switches and/or sensors can be incorporated into the device during its production, or retrofitted to existing devices if need be.

Figure 8A:
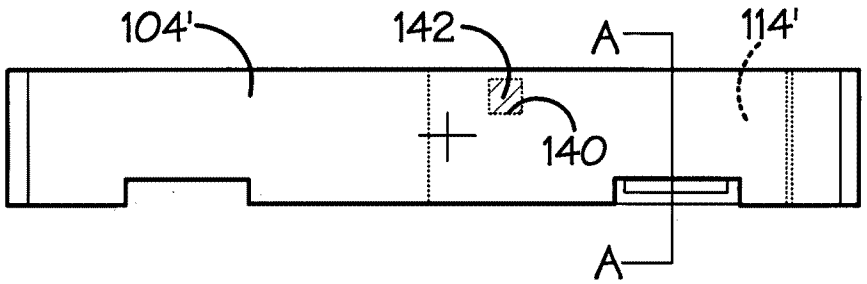
FIGS. 8*a*, 8*b* and 8*c* are front views of a first variant of indicator device for use with the dispensing device of FIG. 1, shown in a retracted position, a first indicating position and a second indicating position respectively.
Figure 8B:
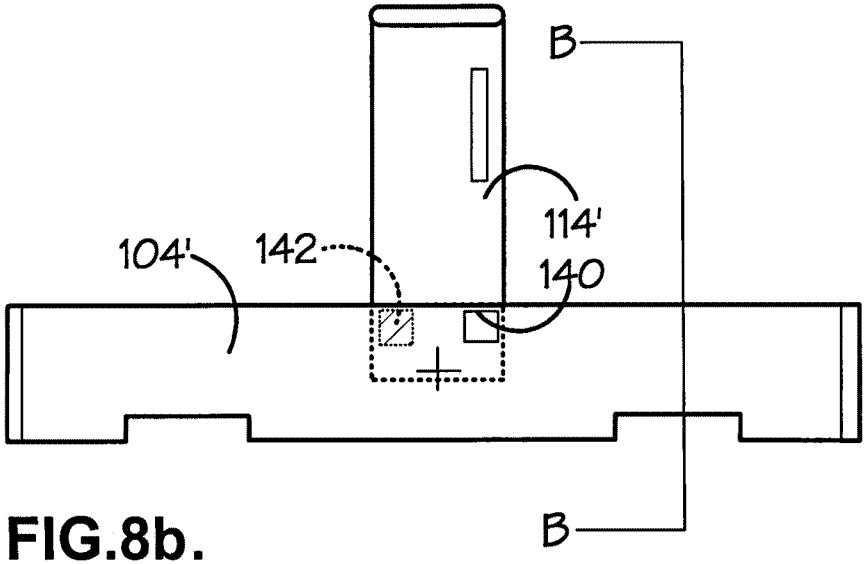
Figure 8C:
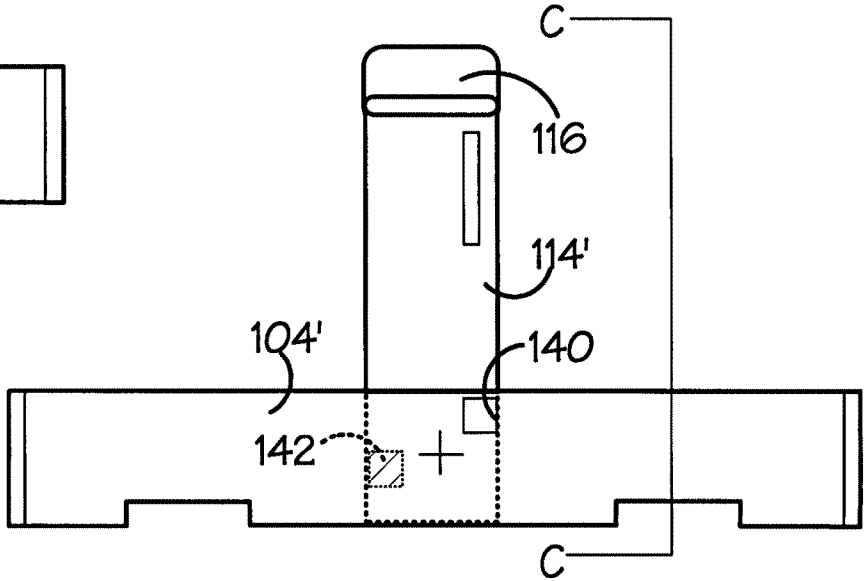
Figure 9A:
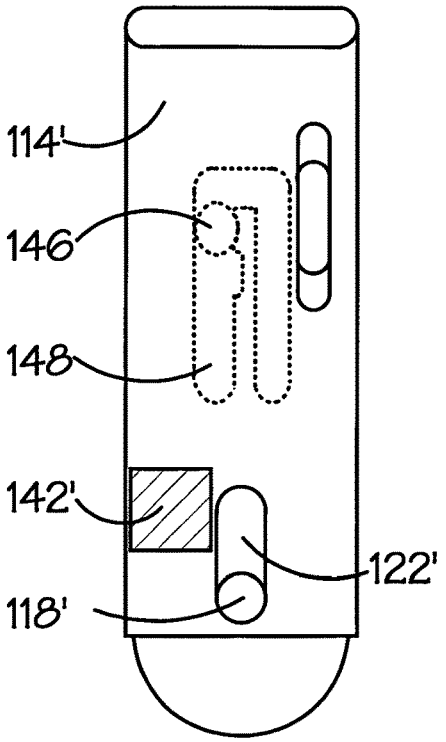
FIGS. 9*a* and 9*b* are front views.
Figure 9B:
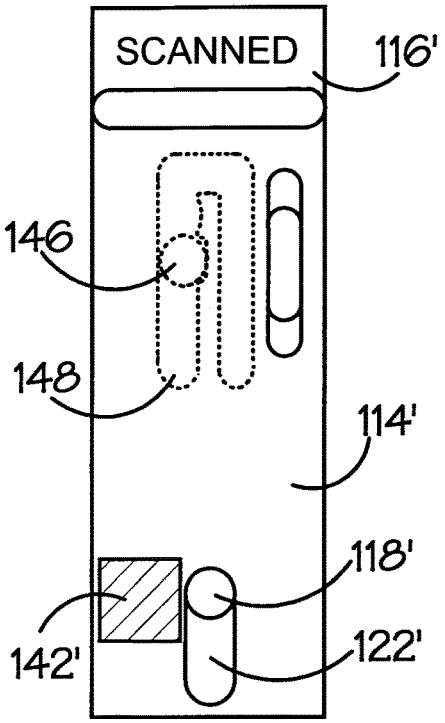
Figure 9C:
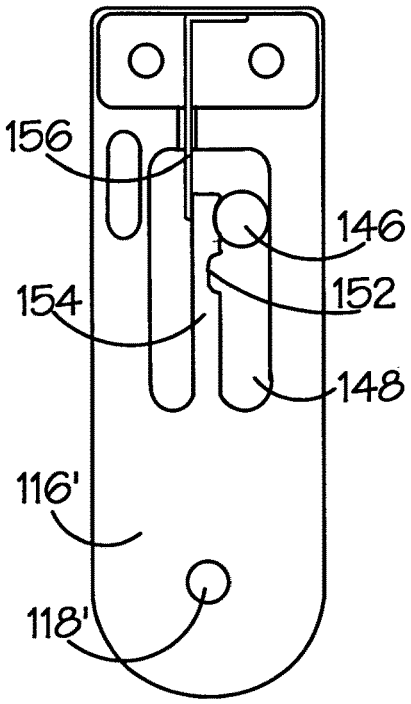
FIGS. 9*c* and 9*d* are rear views, of a second variant of indicator device for use with the dispensing device of FIG. 1, shown in a first indicating position (FIGS. 9*a* and 9*c*) and moving towards a second indicating position (FIGS. 9*b* and 9*d*) respectively.
Figure 9D:
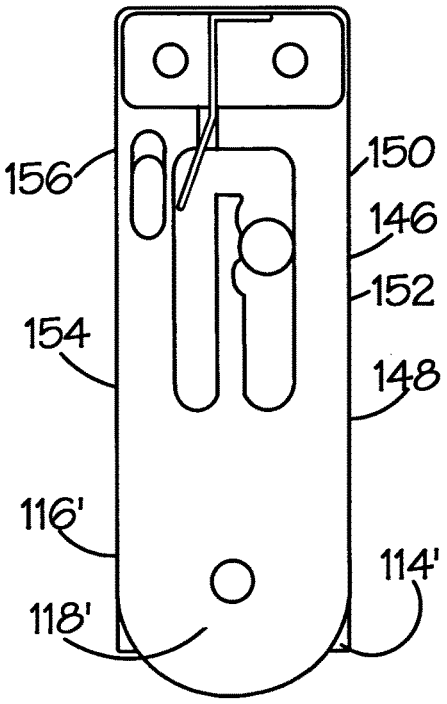

A variation of the dispensing device of FIGS. 1 to 7 is illustrated in FIG. 8. This is identical in all respects to the first embodiment, with the exception that the cover plate 104' is provided with a square cut-out portion 140 forming a window. In addition, the front face of the outermost strip 114 is provided with an area 142 of contrasting colour, for example green, which is visible through the window 140 only when the indicator finger 102 is in its retracted position behind the cover plate 104' but which is otherwise hidden behind solid portions of the cover plate 104'. This serves as a reassurance that the device has products available in the dispensing chamber and that replacement products are also available in the loading chamber. If the frontmost strip 114 is coloured red, the rearmost strip 116 coloured yellow or amber and the additional coloured area 142 on the front face of the outermost strip is coloured green, a user of the device is then given a "traffic light" indication of red, amber/yellow or green as displayed, to indicate the status of the dispensing device.

A second variant of the present invention is illustrated in FIGS. 9 (*a*) to (*d*). This is identical in most respects to the device of FIGS. 1 to 7, as modified by the variation of FIG. 8, and the same features have been given the same reference numerals, with the addition of a prime (').

The main difference is that the frontmost strip 114' and the rearmost strip 116' are interconnected by a detent mechanism such that when the frontmost strip 114' is in its extended position following opening of the gate 24, it can lie either in the position shown in FIG. 9(*a*) in which it fully covers the rearmost strip 116' (in which position only the colour (e.g. red) of the frontmost strip is visible) or in the position shown in FIG. 9(*b*) in which it is displaced downwardly with respect to the rearmost strip 116' (in which position the colour (e.g. yellow) of the top of the rearmost strip is also visible), but not in any position in between.

This is achieved by providing the rear face of the frontmost strip 114' with a small circular lug 146 which can travel in a track 148 in the rearmost strip 116', arranged parallel with the longitudinal axis of the rearmost strip. The track is generally narrower than the diameter of the lug but is provided with two recesses 150, 152 in one side wall of the track which form two portions of track of the same width as the diameter of the lug 146 and which correspond to the position of the lug 146 when in the positions shown in FIGS. 9(*a*) and 9(*b*) respectively. The wall of the track in which the recesses are provided forms one edge of a flexible finger 154 in the rearmost strip 116' and displacement of the frontmost strip 114' causes the finger to flex (since the lug is wider than most portions of the track) as shown in FIGS. 9(*b*) and 9(*d*) until the lug 146 is seated in one of the recesses 150, 152, where the lug is retained by the resilience of the finger 154. A spring 156 mounted on the rearmost strip 116' also bears against the flexible finger 154 to supplement the inherent resilience of the finger 154 when it is displaced.

It will also be observed that the topmost portion of the rearmost strip 116' is printed with the word "SCANNED". In addition to being a different colour (e.g. yellow) than the frontmost strip 114', to serve as additional reassurance that action has been taken to replenish the contents of the upper chamber of the dispenser.

The invention claimed is:

1. A dispensing device comprising:

a housing, the housing comprising:

a loading chamber, a dispensing chamber located beneath the loading chamber and openable to dispense its contents, and a gate or shutter which forms the base of the loading chamber and the upper wall of the dispensing chamber;

the gate or shutter being manually movable between a first, open position in which it is withdrawn from the housing and allows the contents of the loading chamber to drop into the dispensing chamber and a second, closed position in which it is received in the housing and prevents the contents of the loading chamber from dropping into the dispensing chamber;

wherein whenever the gate or shutter is moved from the closed position to the open position, the whole contents of the loading chamber are displaced into the dispensing chamber, the dispensing device further comprising:

first indicating means which displays a first visible signal indicative that the gate or shutter has been moved from the closed position to the open position such that the loading chamber is empty, and second indicating means which can be actuated by a user to display a second visible signal to indicate that the first signal has been observed, wherein the second indicating means can be actuated only after the first visible signal has been displayed.

2. A dispensing device as claimed in claim 1, wherein the first indicating means display the first signal when the gate or shutter is moved from the second, closed position to the first, open position.

3. A dispensing device as claimed in claim 1, comprising means for resetting the first and second indicating means so that the first and second signals respectively are not displayed.

4. A dispensing device as claimed in claim 1, wherein the indicating means includes an indictor finger that is moveable from a retracted position to an extended position.

5. A dispensing device as claimed in claim 2, wherein once the first visible signal is displayed after the gate or shutter is moved to the open position from the closed position, the first visible signal is continuously displayed until reset using resetting means even after the gate or shutter has been moved back to the closed position from the open position.

6. A dispensing device as claimed in claim 1, wherein when said gate or shutter is in said first, open position the loading chamber and the dispensing chamber are in communication with each other and when said gate or shutter is in said second, closed position, the loading chamber and the dispensing chamber are not in communication with each other.

7. A dispensing device comprising:

a housing, the housing comprising:

a loading chamber, a dispensing chamber located beneath the loading chamber and openable to dispense its contents, and a gate or shutter which forms the base of the loading chamber and the upper wall of the dispensing chamber;

the gate or shutter being manually movable between a first, open position in which it is withdrawn from the housing and allows the contents of the loading chamber to drop into the dispensing chamber and a second, closed position in which it is received in the housing and prevents the contents of the loading chamber from dropping into the dispensing chamber;

wherein whenever the gate or shutter is moved from the closed position to the open position, the whole contents of the loading chamber are displaced into the dispensing chamber, the dispensing device further comprising:

first indicating means for displaying a first visible signal indicative that the loading chamber is empty, and second indicating means which is selectively actuable by a user to display a second visible signal to indicate that the first signal has been observed, wherein the first indicating means comprises a first indicator member which is retainable in a first, retracted position when the gate or shutter is in the closed position, and which is displaceable to a second, extended position when the gate or shutter is moved from the closed position to the open position.

8. A dispensing device as claimed in claim 7, comprising means for biasing the indicator member from the retracted position to the extended position.

9. A dispensing device as claimed in claim 8, wherein the biasing means comprises a spring.

10. A dispensing device as claimed in claim 7, wherein the first indicating means is pivotally mounted and is pivotable between the first, retracted position and the second, extended position.

11. A dispensing device as claimed in claim 7, wherein the first indicator member is elongate.

12. A dispensing device as claimed in claim 11, wherein the elongate first indicator member is pivotally mounted at or towards one end.

13. A dispensing device as claimed in claim 7, wherein the second indicating means comprises a second indicator member which is retainable in a first, retracted position when the gate or shutter is in the closed position and which is displaceable to a second, extended position when the gate or shutter is moved from the closed position to the open position.

14. A dispensing device as claimed in claim 13, wherein one of the first and second indicator members is movable relative to the other to adjust the extent to which the other member is visible.

15. A dispensing device as claimed in claim 14, wherein one of the first and second indicator members is movable relative to the other indicator member from a first position in which the other indicator member is substantially completely obscured to a second position in which the other indicator member is partially revealed.

16. A dispensing device as claimed in claim 15, wherein the first indicator member is movable from a first position in which the second indicator member is substantially obscured to a second position in which a portion of the second indicator member is revealed.

17. A dispensing device as claimed in claim 15, wherein when the movable first indicator member is in the second position with respect to the other indicator member, the first and second indicator members are prevented from being displaced to the first, retracted position.

18. A dispensing device as claimed in claim 7, comprising retaining means movable with the gate or shutter which are engageable with the first indicator member to retain the first indicator member in the first, retracted position.

19. A dispensing device as claimed in claim 7, wherein when the first indicator member is displaced to the second, extended position, it impedes access to the loading chamber.

20. A dispensing device as claimed in claim 7, wherein when said gate or shutter is in said first, open position the loading chamber and the dispensing chamber are in communication with each other and when said gate or shutter is in said second, closed position, the loading chamber and the dispensing chamber are not in communication with each other.

21. A dispensing device comprising:

a housing, the housing comprising:

a loading chamber, a dispensing chamber located beneath the loading chamber and openable to dispense its contents, and a gate or shutter which forms the base of the loading chamber and the upper wall of the dispensing chamber;

the gate or shutter being movable manually between a first, open position in which it is withdrawn from the housing and allows the contents of the loading chamber to drop into the dispensing chamber and a second, closed position in which it is received in the housing and prevents the contents of the loading chamber from dropping into the dispensing chamber;

wherein whenever the gate or shutter is moved from the closed position to the open position, the whole contents of the loading chamber are displaced into the dispensing chamber, the dispensing device further comprising:

first visual indicating means comprising a first indicator member displaceable between a first, retracted position and a second, visible extended position and being retained in the first, retracted position when the gate or shutter is in the closed position and which is displaced to the second, visible extended position when the gate or shutter is moved from the closed position to the open position.

22. A dispensing device as claimed in claim 21, comprising means for biasing the indicator member from the retracted position to the extended position.

23. A dispensing device as claimed in claim 22, wherein the biasing means comprises a spring.

24. A dispensing device as claimed in claim 21, wherein the first indicator member is pivotally mounted and is pivotable between the first, retracted position and the second, extended position.

25. A dispensing device as claimed in claim 21, wherein the first indicator member is elongate.

26. A dispensing device as claimed in claim 25, wherein the elongate first indicator member is pivotally mounted at or towards one end.

27. A dispensing device as claimed in claim 21, further comprising second indicating means, comprising a second indicator member which is retainable in a first, retracted position when the gate or shutter is in the closed position and which is displaceable to a second, extended position when the gate or shutter is moved from the closed position to the open position.

28. A dispensing device as claimed in claim 27, wherein one of the first and second indicator members is movable relative to the other to adjust the extent to which the other member is visible.

29. A dispensing device as claimed in claim 28, wherein one of the first and second indicator members is movable relative to the other indicator member from a first position in which the other indicator member is substantially completely obscured to a second position in which the other indicator member is partially revealed.

30. A dispensing device as claimed in claim 29, wherein the first indicator member is movable from a first position in which the second indicator member is substantially obscured to a second position in which a portion of the second indicator member is revealed.

31. A dispensing device as claimed in claim 29, wherein when the movable first indicator member is in the second position with respect to the other indicator member, the first and second indicator members are prevented from being displaced to the first, retracted position.

32. A dispensing device as claimed in claim 21, comprising retaining means movable with the gate or shutter which are engagable with the first indicator member to retain the first indicator member in the first, retracted position.

33. A dispensing device as claimed in claim 21, wherein when the first indicator member is displaced to the second, extended position, it impedes access to the loading chamber.

34. A dispensing device as claimed in claim 21, wherein when said gate or shutter is in said first, open position the loading chamber and the dispensing chamber are in communication with each other and when said gate or shutter is in said second, closed position, the loading chamber and the dispensing chamber are not in communication with each other.

* * * * *